US006206005B1

(12) United States Patent
Keyes

(10) Patent No.: US 6,206,005 B1
(45) Date of Patent: Mar. 27, 2001

(54) METHOD OF ASSISTING IN CHILD BIRTH WITH ACCESSIBLE BIRTH WEAR

(76) Inventor: V. Carolyn Keyes, Route 1, Box 43A, Letart, WV (US) 25253

( * ) Notice: Subject to any disclaimer, the term of this patent is extended or adjusted under 35 U.S.C. 154(b) by 0 days.

(21) Appl. No.: 09/282,438

(22) Filed: Mar. 31, 1999

Related U.S. Application Data

(62) Division of application No. 08/935,323, filed on Sep. 22, 1997, now Pat. No. 5,913,407.
(60) Provisional application No. 60/051,783, filed on Jul. 7, 1997, now abandoned.

(51) Int. Cl.[7] ..... A61B 19/00
(52) U.S. Cl. ..... 128/898; 606/121
(58) Field of Search ..... 128/898; 2/114, 2/83, 80, 104, 247, 78.2; 606/121

(56) References Cited

U.S. PATENT DOCUMENTS 1,462,515 * 7/1923 McElroy ..... 2/114
1,489,046 * 4/1924 Thompson ..... 2/114
1,937,591 * 12/1933 Rieffannacht ..... 2/83
1,973,659 * 9/1934 Rieffannacht ..... 2/83
2,166,727 * 7/1939 Mott ..... 2/83
2,520,026 * 8/1950 Beitchman ..... 2/83
2,689,958 * 9/1954 Gray ..... 2/83
3,144,659 * 8/1964 Matthew ..... 2/83
4,422,186 * 12/1983 Loney ..... 2/114
5,611,087 * 3/1997 Adkins ..... 2/114
5,652,962 * 8/1997 Pathode ..... 2/114
5,913,407 * 6/1999 Keyes ..... 2/83

* cited by examiner

*Primary Examiner*—David J. Isabella
*Assistant Examiner*—Kelly O'Hara
(74) *Attorney, Agent, or Firm*—Robert N. Blackmon

(57) ABSTRACT

Birthwear is provided comprising a top (shirt) and a bottom (pants) wherein the bottom has a front cloth layer and back cloth layer and an inner (crouch) seam (inseam) having a plurality of releasably coupled elements (snaps) releasably attaching the front layer to the back layer. The top also preferably has a pocket on the front layer containing a hole for insertion of monitoring wires. The top preferably has an upper seam which runs along the shoulder and arms of the garment which has a plurality of coupling elements (snaps) for releasably coupling the upper end of a front layer of the shirt with a upper end of a back layer of the shirt. The shirt preferably also has a back seam which runs from the neck of the shirt to the waist of the shirt along the center of the back providing the back with two back portions which are releasably coupled with coupling elements (snaps) for permitting selective access to the back of the wearer. The present invention also involves a method for birthing comprising providing the above shorts, unsnapping (uncoupling) the coupling elements (snaps) and accessing the inner leg region of the wearer. The present birthing suit, specifically the bottoms, permit adequate access to the abdomen, perineum and chest while eliminating unnecessary exposure of the body in early and active laboring.

11 Claims, 3 Drawing Sheets

METHOD OF ASSISTING IN CHILD BIRTH WITH ACCESSIBLE BIRTH WEAR

This application is a division of application Ser. No. 08/935,323 filed Sep. 22, 1997, now U.S. Pat. No. 5,913, 407, entitled Birthwear and Method Related Thereto, which is hereby incorporated by reference. This application also claims the benefit of U.S. Provisional Application No. 60/051,783 filed Jul. 7, 1997, now abandoned.

BACKGROUND OF THE INVENTION

1. Field of the Invention

The present invention relates to hospital clothing, and more particularly relates to hospital clothing for utilization during birthing.

2. Description of the Related Art

Hospital gowns typically involve a full length gown having an open back which may be drawn together by cloth draw strings attached to the back of the gown. Such gowns have historically suffered from being ineffective at conveniently covering the body of the user leading to a lack of privacy and inconvenience during use and do not generally permit adequate accessibility of areas such as the abdomen, perinem and chest areas.

Consequently, there is a need and desire for clothing suitable for pregnant women which will eliminate unnecessary exposure of the body during hospital stays and which will permit adequate accessibility of areas such as abdomen, perineum and chest areas.

SUMMARY OF THE INVENTION

Birthwear is provided comprising a top (shirt) and a bottom (pants, jams) wherein the bottom has a front cloth layer (front) and back cloth layer (back) and an inner (crouch) seam (inseam) having a plurality of releasably coupled elements (snaps) releasably attaching the front layer to the back layer. The top preferably has a pocket on the front layer containing a hole (in the front layer) for insertion of monitoring wires. The top preferably has an upper seam which runs along the shoulder and top of the arms of the garment which has a plurality of coupling elements (snaps) (along the upper seam) for releasably coupling the upper end of a front layer of the shirt with a upper end of a back layer of the shirt. The shirt preferably also has a back seam which runs from the neck of the shirt to the waist of the shirt along the center of the back providing the back with two back portions which are releasably coupled with coupling elements (snaps) for permitting selective access to the back of the wearer (person, pregnant woman). The present invention also involves a method for birthing comprising providing the above shorts, (unsnapping) uncoupling the coupling elements (snaps) and accessing the perineum (pelvis, urogenital passages, inner leg region) of the wearer. The present birthing suit permits adequate access to the abdomen, perineum and chest while eliminating unnecessary exposure of the body in early and active laboring.

DETAILED DESCRIPTION OF THE INVENTION

Figure 5:
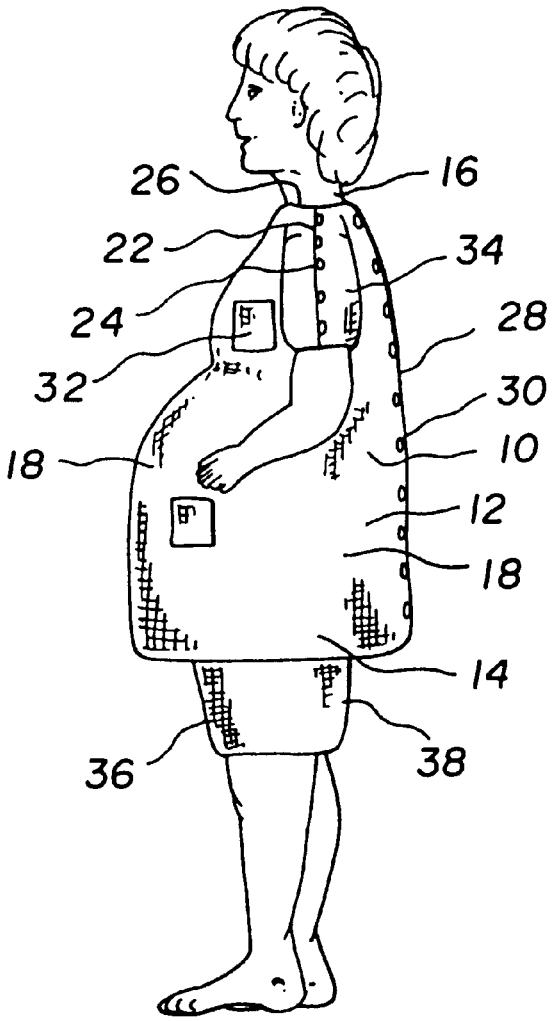
FIG. 5 is a side elevational view of a pregnant woman wearing a birthwear suit according to the present invention.

As best shown in FIG. 5, an expectant mother (pregnant woman) (16) wears the birthing outfit (suit) (10) which comprises a top (12) and a bottom (14).

Figure 1:
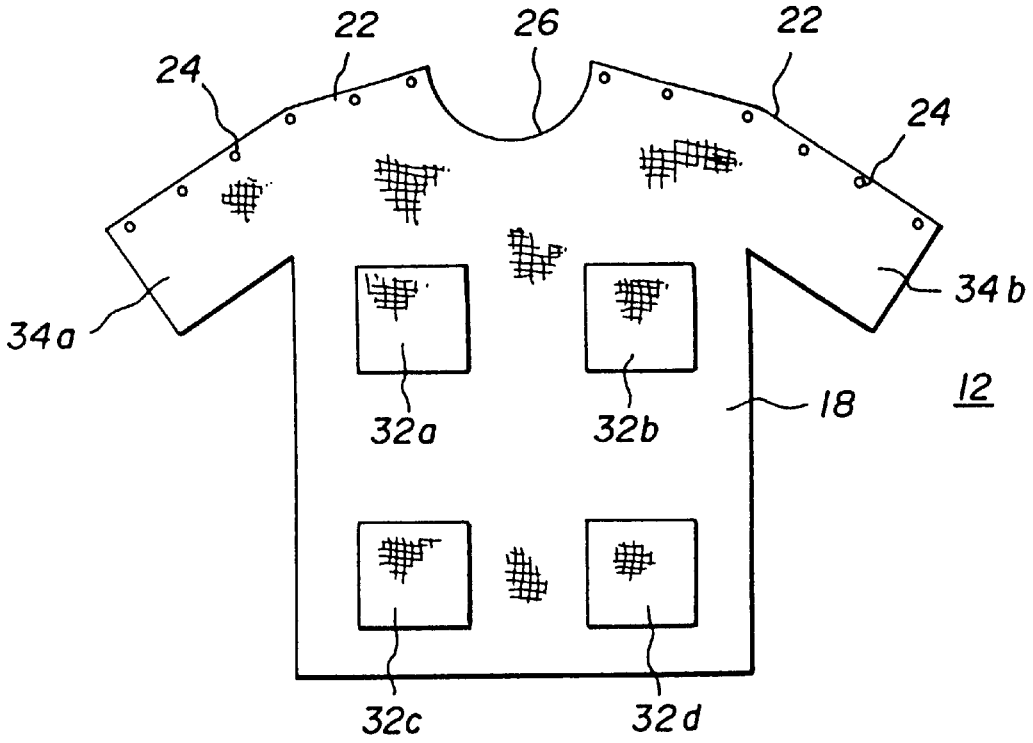
FIG. 1 is a front elevational view of a shirt according to the present invention.
Figure 3:
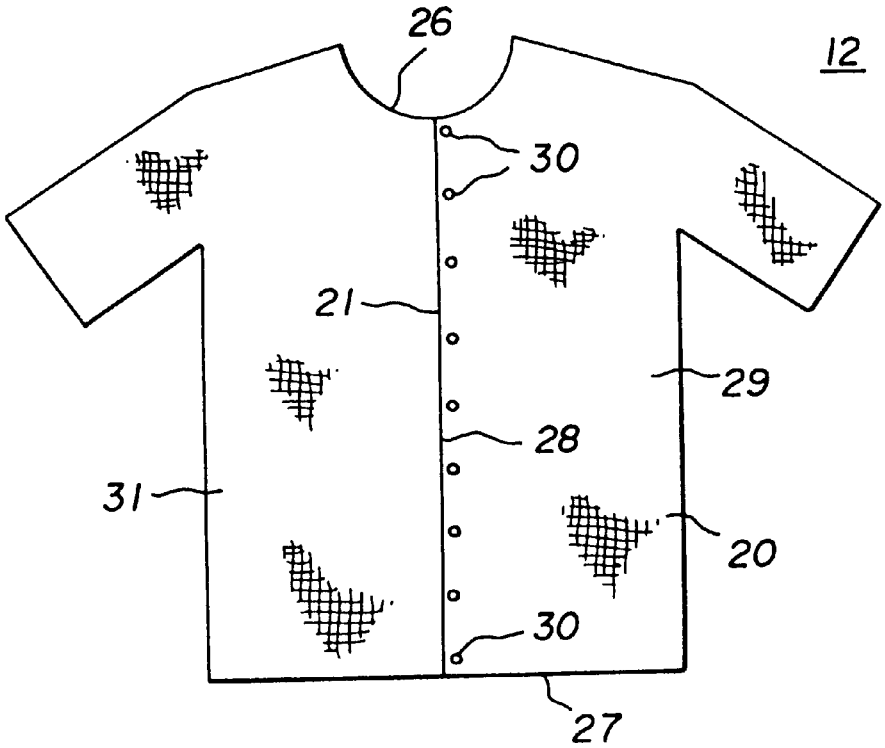
FIG. 3 is a rear elevational view of the shirt of FIG. 1.

As shown in FIGS. 1 and 3, the top (12) preferably comprises a front (18) and a back (20) which are in the form of cloth (fabric) layers. The top (shirt) (12) has an upper seam (22) which runs along the shoulder and upper (outer) arm regions of the shirt (12). The upper seam (22) has snaps (coupling elements) (24) which releasably couple the front layer (18) and the back layer (20) at the respective upper regions of the layers (18,20). The shirt (12) has a neck opening (26) for the neck of the mother (16). The shirt (12) also preferably has a back seam (28) which runs from the neck opening (26) to the waist region (lower region) (27) of the shirt (12) along the center line of the back layer (20) adjacent the spine of the mother (16), and preferably has coupling elements (30) (snaps) for releasably coupling the right (29) and lefthand (31) portions of the back layer (20) created by the back seam (21). The front (18) of the shirt (12) preferably has at least one shirt pocket (32*a,b,c,d*), and as shown in FIG. 1, the shirt also has sleeves (34*a, b*).

Figure 2:
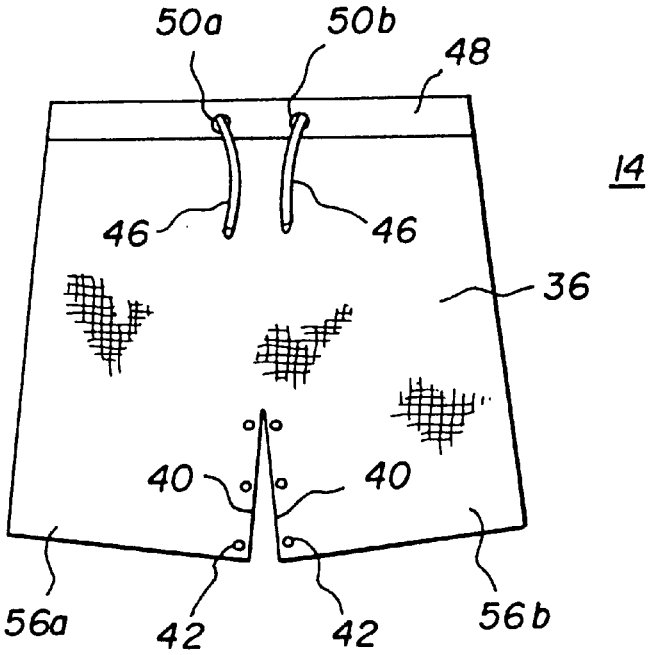
FIG. 2 is a front elevational view of a bottom according to the present invention.
Figure 4:
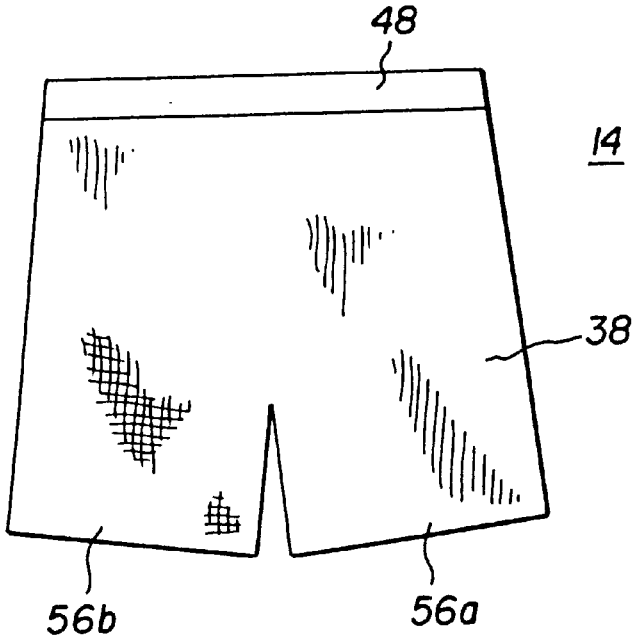
FIG. 4 is a rear elevational view of the bottom of FIG. 2.

The bottom (14) as best shown in FIGS. 2 and 4, preferably has a front layer (36) and a back layer (38). The bottom (14) has an inner crotch seam (40) wherein the front and back layers (36, 38) are releasably coupled by a plurality of snaps (42) (coupling elements). The bottom (14) also preferably has a draw string (46) which is retained within an elastic tube (48) which has frontal ports (50*a, b*) for permitting end portions of the draw string (46) to extend therefrom. The bottoms (14) have pant legs (56*a, b*).

Figure 6:
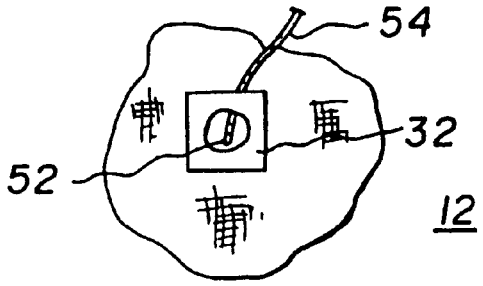
FIG. 6 is a cutaway of a pocket of a top having a front portion of a pocket cover panel cutaway to show an insertion hole.

As best shown in FIG. 6, the front birthwear top (12) also preferably has a two-inch button hole (52) for an EKG lead (wiring) (54) accessibility to be placed through the left pocket (32) for monitoring of the mother (16). The snaps placed on each arm (sleeve) (34) allows for easy accessibility of IV tubing maneuverability and to allow for exposure of a breast to breast feed an infant. The top (12) preferably also has an upper pair of pockets (32*a, b*) and a lower pair of pockets (32*c, d*) each having two inch button holes behind each of the pocket covers to allow for telemetry of fetal heart rate (lead accessibility). The back of the top (12) also has snaps, discussed above, to allow for accessibility for back exposure to administer anesthesia such as epidurals, intrathecals and spinals. The bottoms (pants, jams) (14) have the holes (50*a, b*) for placement of the draw strings about the middle of the waist of the mother (person). Elastic in the waist allows for expansion of waist to place monitors on the abdomen for transducer (fetal heart) and to monitor to determine uterine contraction frequency and duration. Snaps placed in the inner legs (inseams) allow for accessibility of perineal area for sterile vaginal exams, artificial rupture of amniotic membranes, placement of intrauterine pressure catheter, foley insertion, exposure of perineal area for vaginal delivery or exposure of abdomen for cesarean delivery.

The present birthing wear will eliminate unnecessary exposure of the body in early and active laboring of patients, will promote individualism and freedom of choice of clothing to wear and labor and delivery, will provide adequate accessibility of areas such as abdomen, perineum and chest, and could be kept and saved by the user as a keepsake, heirloom and/or clothing usable for future hospital stays.

What is claimed is:

1. A method for birthing comprising the steps of:

(a) providing a pant bottom on a pregnant woman, said bottom having an inseam comprising a plurality of releasable coupling elements, (b) uncoupling the coupling elements to permit access to perineum area of the woman, and (c) accessing the perineal area of the wearer through the opening to assist the woman during birthing.

2. The method of claim 1, including the additional steps of:

(d) providing a top for the pregnant woman, said top including at least one pocket having an access hole therein for receiving a monitoring wire; and (e) extending said monitoring wire within said holes to monitor the woman wearing the top.

3. The method of claim 2, including the additional step of (f) providing said top with a seam across the shoulder thereof; wherein said shoulder seam has a plurality of coupling elements for releasably coupling a front layer to a back layer of said shirt and permitting the shirt to be opened along the upper most region thereof.

4. The method of claim 3, including the additional steps of (g) providing said top with a central back seam extending from a neck region of the shirt to a waist region of the shirt, said central back seam being releasably coupled by a plurality of coupling elements.

5. The method of claim 1, including the additional steps of (d) providing said bottom with a draw string for tightening about the waist of a wearer.

6. A method of providing personal privacy to a hospital patient while providing selective access to the abdomen, perineum and chest area of the patient including the steps of:

(a) providing a pant bottom on a woman patient, said bottom having an inseam comprising a plurality of releasable coupling elements;

(b) uncoupling the coupling elements to permit access to perineum area of the woman; and (c) accessing the perineal area of the wearer through the opening to assist the woman during birthing.

7. The method of claim 6, including the additional steps of (d) providing said bottom with a front cloth layer and a back cloth layer, said bottom having an inner crotch inseam, said inner crotch inseam having a plurality of releasably coupled elements for releasably attaching the front layer to the back layer.

8. The method of claim 6, including the additional step of (d) providing a top shirt, separate and unattached to said bottom.

9. The method of claim 8, including the additional steps of (e) providing said top shirt with a top layer and a bottom layer joined together to form said top shirt, and (f) providing at least one pocket on said front layer, said pocket having an exterior pocket layer, said front layer having means defining a hole within said pocket for providing access to an interior of said top shirt.

10. The method of claim 9, including the additional steps of (e) providing said top with having at least three of said pockets.

11. The method of claim 9, including the additional steps of (e) providing said top with having at least four of said pockets.

* * * * *